US009476590B2

(12) United States Patent
Huang et al.

(10) Patent No.: US 9,476,590 B2
(45) Date of Patent: Oct. 25, 2016

(54) METHOD OF TESTING AND COMPENSATING GAS SUPPLY OF GAS APPLIANCE FOR SAFETY

(75) Inventors: Chung-Chin Huang, Taichung (TW); Chin-Ying Huang, Taichung (TW); Hsin-Ming Huang, Taichung (TW); Hsing-Hsiung Huang, Taichung (TW)

(73) Assignee: GRAND MATE CO., LTD., Taichung (TW)

( * ) Notice: Subject to any disclaimer, the term of this patent is extended or adjusted under 35 U.S.C. 154(b) by 245 days.

(21) Appl. No.: 12/985,088

(22) Filed: Jan. 5, 2011

(65) Prior Publication Data

US 2012/0154159 A1 Jun. 21, 2012

(51) Int. Cl.

| | |
|---|---|
| ***G08B 21/00*** | (2006.01) |
| ***F23N 5/24*** | (2006.01) |
| ***F23K 5/00*** | (2006.01) |
| ***F23N 1/00*** | (2006.01) |
| ***F23N 5/18*** | (2006.01) |

(52) U.S. Cl.

CPC ..... *F23N 5/242* (2013.01); *F23K 5/007* (2013.01); *F23N 1/002* (2013.01); *F23N 5/184* (2013.01); *F23K 2401/201* (2013.01); *F23K 2900/05001* (2013.01); *F23N 2005/185* (2013.01)

(58) Field of Classification Search

CPC ..... F23D 14/20; F23D 14/22; F23D 14/24; F23D 14/02; F23D 14/60; F23N 2025/06; F23N 2035/16; F23N 2005/185; F23N 1/02

USPC ..... 340/605–606; 116/112, 264–276; 137/557

See application file for complete search history.

(56) References Cited

U.S. PATENT DOCUMENTS

| | | | | |
|---|---|---|---|---|
| 3,772,880 | A * | 11/1973 | Kubota et al. | 60/773 |
| 3,902,316 | A * | 9/1975 | Huellmantel | 60/39.23 |
| 4,637,296 | A * | 1/1987 | Hirosaki et al. | 454/333 |
| 4,688,547 | A * | 8/1987 | Ballard et al. | 126/116 A |
| 4,717,071 | A * | 1/1988 | Capone | 236/15 E |
| 4,817,375 | A * | 4/1989 | Brocard et al. | 60/39.281 |
| 5,445,019 | A * | 8/1995 | Glidewell et al. | 73/114.51 |
| 5,520,537 | A * | 5/1996 | Taylor | 431/353 |
| 5,554,976 | A * | 9/1996 | Miyauchi et al. | 340/626 |
| 6,206,687 | B1 * | 3/2001 | Redington | 431/90 |
| 6,404,345 | B1 * | 6/2002 | Frasier | 340/626 |
| 6,694,926 | B2 * | 2/2004 | Baese et al. | 122/14.2 |
| 8,234,872 | B2 * | 8/2012 | Berry et al. | 60/737 |
| 2004/0024516 | A1 * | 2/2004 | Hook et al. | 701/100 |

(Continued)

OTHER PUBLICATIONS

Mehrayin (http://web.ornl.gov/sci/de_materials/10_Mehrayin.pdf. pdf, Jan. 2002, pp. 1-27).*

*Primary Examiner* — Firmin Backer
*Assistant Examiner* — Nay Tun
(74) *Attorney, Agent, or Firm* — Tracy M. Heims; Lynette Wylie; Apex Juris, pllc.

(57) ABSTRACT

The present invention provides a method of testing gas supply of a gas appliance, which includes the steps of: monitoring a flow rate of a gas flow through a gas regulator of a pipeline to have a detected gas flow rate; comparing the detected gas flow rate with the ideal range of gas flow rate; and providing an alarm when the detected gas flow rate exceeds the ideal range of gas flow rate. The present invention further provides a compensating method when an abnormal condition is detected. The compensating method will change the gas flow rate or the air flow rate to get a proper air fuel ratio of the mixed gas.

4 Claims, 4 Drawing Sheets

(56) References Cited

U.S. PATENT DOCUMENTS

2005/0250062 A1* 11/2005 Kornbluth et al. ..... 431/79
2007/0221276 A1* 9/2007 Buezis et al. ..... 137/613
2008/0185049 A1* 8/2008 Mulligan et al. ..... 137/382
2010/0095905 A1* 4/2010 Smelcer ..... 122/14.2
2010/0170582 A1* 7/2010 Koba et al. ..... 137/487.5
2011/0248856 A1* 10/2011 Obenchain ..... A61M 16/20
340/606

* cited by examiner

METHOD OF TESTING AND COMPENSATING GAS SUPPLY OF GAS APPLIANCE FOR SAFETY

BACKGROUND OF THE INVENTION

1. Field of the Invention

The present invention relates generally to a safe use of a gas appliance, and more particularly, to a method of testing and compensating gas supply for safety.

2. Description of the Related Art

Home gas appliances, such as gas water heater, gas stove, and other appliances which burn gas, have a hose connected to a gas supply. The gas supply provides the gas appliance gas, and the gas is mixed with air in the gas appliance in a proper ratio (a target air fuel ratio, A/F ratio) for burning. With a low A/F ratio, which means there is more air in the mixed gas, it is difficult to burn the mixed gas, while with a high A/F ratio, there is more gas in the mixed gas, hence it is easy to have an incomplete burning function, and that will generate carbon monoxide, which is toxic to human. To have a safe use of the gas appliances in the market, the manufacturers had preset proper gas flow rates for various types of gas appliances. It assumes that the gas supply has a constant pressure to provide a proper and constant gas flow rate to the gas appliance by choosing a hose with a suitable cross section. As a result, it will have a mixed gas with an optimal A/F ratio in the gas appliance.

However, abnormality of the A/F ratio is hard to detect when the gas appliance is in use. Even through the user is aware of gas or carbon monoxide in the air, he/she might think that it is caused by malfunction of the gas appliance rather than the improper A/F ratio of the mixed gas, thus when a technician changes some parts inside the gas appliance, it still doesn't fix the problem. In other words, some problems of the abnormal burning activity of the gas appliance is caused by gas supply, rather than the gas appliance itself. Too high or too low pressure of the gas supply will cause an improper A/F ratio of the mixed gas, and that is the key reason to the abnormal burning activity of the gas appliance. However, the abnormality of the gas supply is hard to detect, and the user often put the blame on the gas appliance when it is functioning abnormally and can't be fixed. It is common to think that there is a problem with function of the gas appliance when accidents happen, even though it is often not the case.

SUMMARY OF THE INVENTION

The primary objective of the present invention is to provide a method of testing and compensating a gas supply, which may find where the abnormal point is within the gas appliance, and provide an alarm, it will also automatically adjust the gas supply to a normal condition.

According to the objective of the present invention, the present invention provides a gas appliance having a control unit which is stored with an ideal range of gas flow rate, and a pipeline connected to the gas appliance to supply gas to the gas appliance. The method of testing gas supply of the gas appliance includes monitoring a flow rate of a gas flow through a gas regulator of the pipeline, to obtaining a detected gas flow rate; comparing the detected gas flow rate with the ideal range of gas flow rate; and providing an alarm when the detected gas flow rate exceeds the ideal range of gas flow rate.

The present invention further provides a compensating method to recover the gas supply when an abnormal condition is detected. The compensating method includes the step of reducing the flow rate of the gas flow in the pipeline when the detected gas flow rate is higher than a high limit of the ideal range of gas flow rate, or raising the flow rate of the gas flow in the pipeline when the detected gas flow rate is lower than a low limit of the ideal range of gas flow rate, until the detected gas flow rate has fallen back into the ideal range of gas flow rate.

The present invention further provides another compensating method which includes the step of raising an air flow rate of an air flow into the gas appliance when the detected gas flow rate is higher than a high limit of the ideal range of gas flow rate, or reducing the air flow rate of the air flow into the gas appliance, when the detected gas flow rate is lower than a low limit of the ideal range of gas flow rate, until the detected gas flow rate has fallen back into the ideal range of gas flow rate.

DETAILED DESCRIPTION OF THE INVENTION

Figure 1:
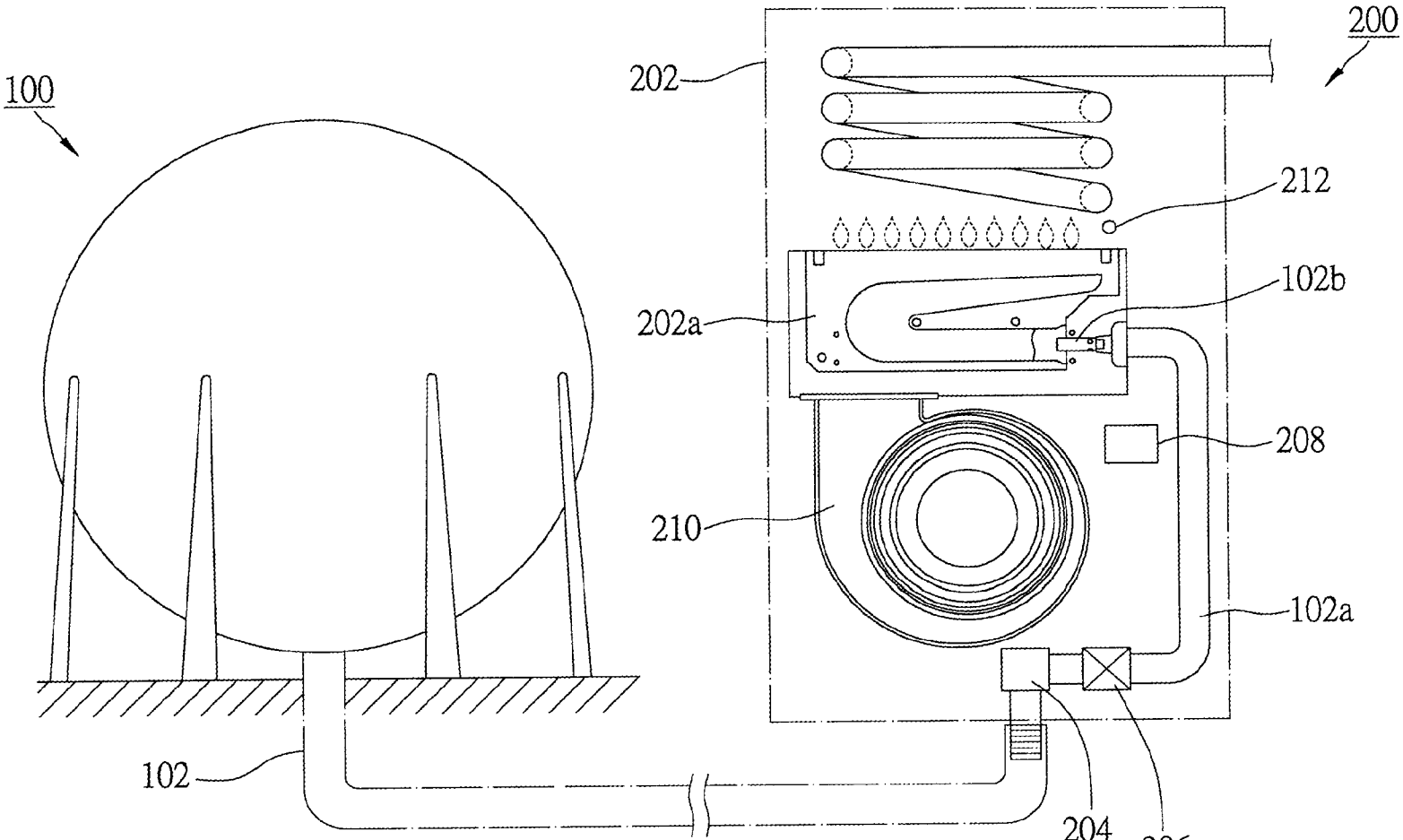
FIG. 1 is a sketch diagram of the gas supply end and the gas appliance of a first preferred embodiment of the present invention.

As shown in FIG. 1, under an ideal condition, a gas supply end 100 has a pipeline 102 to convey gas to a gas appliance 202. The pipeline 102 includes a pipe 102*a* in the gas appliance 202. The gas supply end 100 provides a constant gas pressure. The pipeline 102 is provided with a gas regulator 204 to adjust a cross section of the pipeline 102 that may keep a constant gas flow rate at an outlet 102*b* of the pipe 102*a* to get to a target air fuel rate (A/F rate). The outlet 102*b* of the pipe 102*a* is located in a combustor 202*a* of the gas appliance 202. The gas supply end 100 has a gas tank to store gas, and the gas appliance 202 is a gas water heater in the present embodiment. However, it is known that they should be not limited in the description.

The testing method of the present invention is testing that gas flow rate of an user end 200 to identify where an abnormal point happens (the gas supply end 100 or the user end 200). The present invention provides a compensating method also to automatically adjust an abnormal gas flow rate to a normal gas flow rate to supply to the gas appliance.

Figure 2:
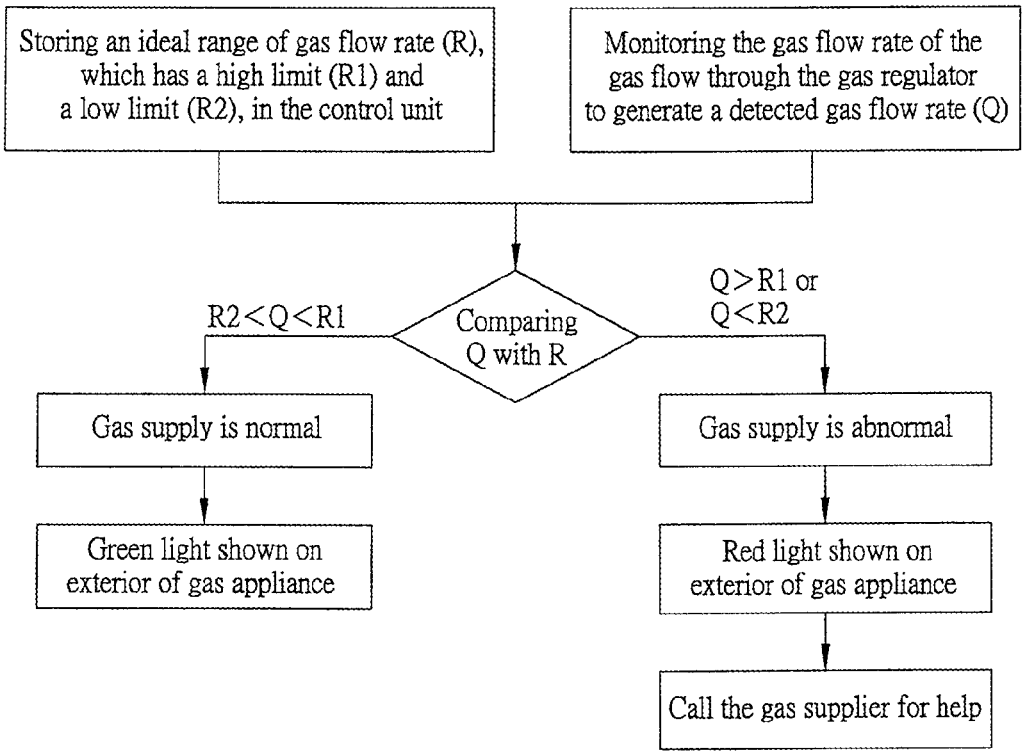
FIG. 2 is a flow chart of a testing procedure of the first preferred embodiment of the present invention.

As shown in FIG. 2, devices for the testing method of the present invention include a sensor 206 to monitor the gas flow rate. The sensor 206 is installed on the pipe line 102 adjacent to the gas regulator 204, which is between the gas regulator 204 and the outlet 102*b*. The sensor 206 is electrically connected to a control unit 208. In the present embodiment, the gas regulator 204 is an electronic proportional valve by the control unit 208 to adjust a cross section of the pipeline 102 according to voltage. The gas regulator 204 may be a stepper motor controlled by the control unit 208.

The control unit 208 has a database. The database has an ideal range of gas flow rate R. When a gas flow rate in the pipeline is in the ideal range of gas flow rate R, it may provide the gas appliance a proper gas to be mixed with air and achieve a target A/F ratio. The ideal range of gas flow rate R has a high limit R1 and a low limit R2.

The testing method of the present invention includes requesting the sensor 206 to monitor a gas flow rate through the gas regulator 204 when the gas regulator 204 is under an initial condition and generate a detected gas flow Q. A signal indicating the detected gas flow Q is transmitted to the control unit 208. After that, the control unit 208 will examine the detected gas flow Q as the followings:

1) When the detected gas flow Q falls between the high limit R1 and the low limit R2 of the ideal range of gas flow rate R, it indicates that the gas supply is normal, and the control unit 208 will indicate a green light (not shown) on the gas appliance to tell user that the gas supply is under a normal condition.

2) When the detected gas flow Q is beyond the high limit R1 and the low limit R2 of the ideal range of gas flow rate R, it indicates that the gas supply is abnormal, and the control unit 208 will indicate an alarm, such as a red light, to warn user that the gas supply is under an abnormal condition (the pressure of the gas from the gas supply end is too high or too low). User is informed that the problem happened at the gas supply end and not the gas appliance itself, and the user should call the gas supply end for help, not the gas appliance supplier.

Figure 3:
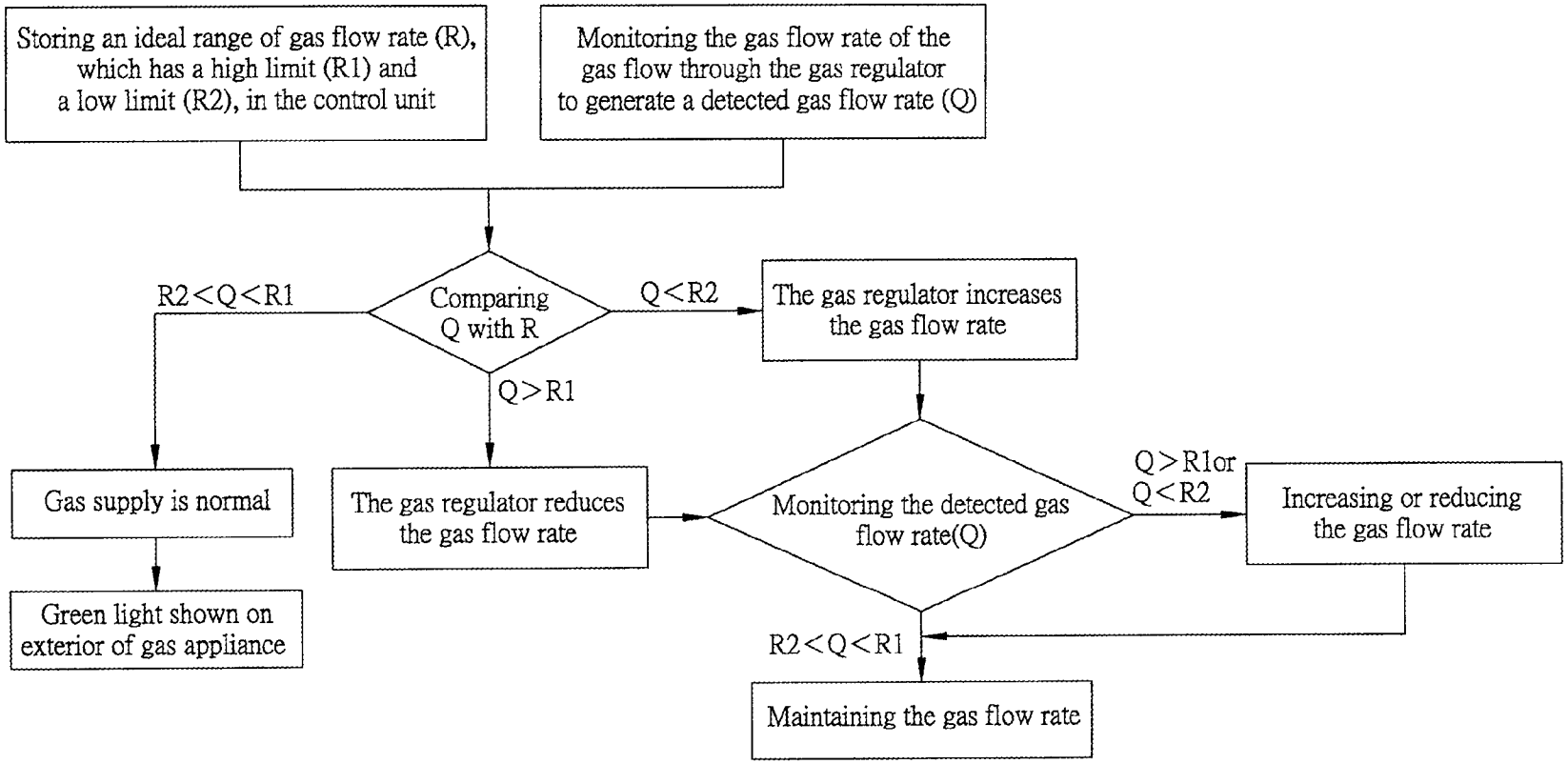
FIG. 3 is a flow chart of a compensating procedure of the first preferred embodiment of the present invention.
Figure 4:
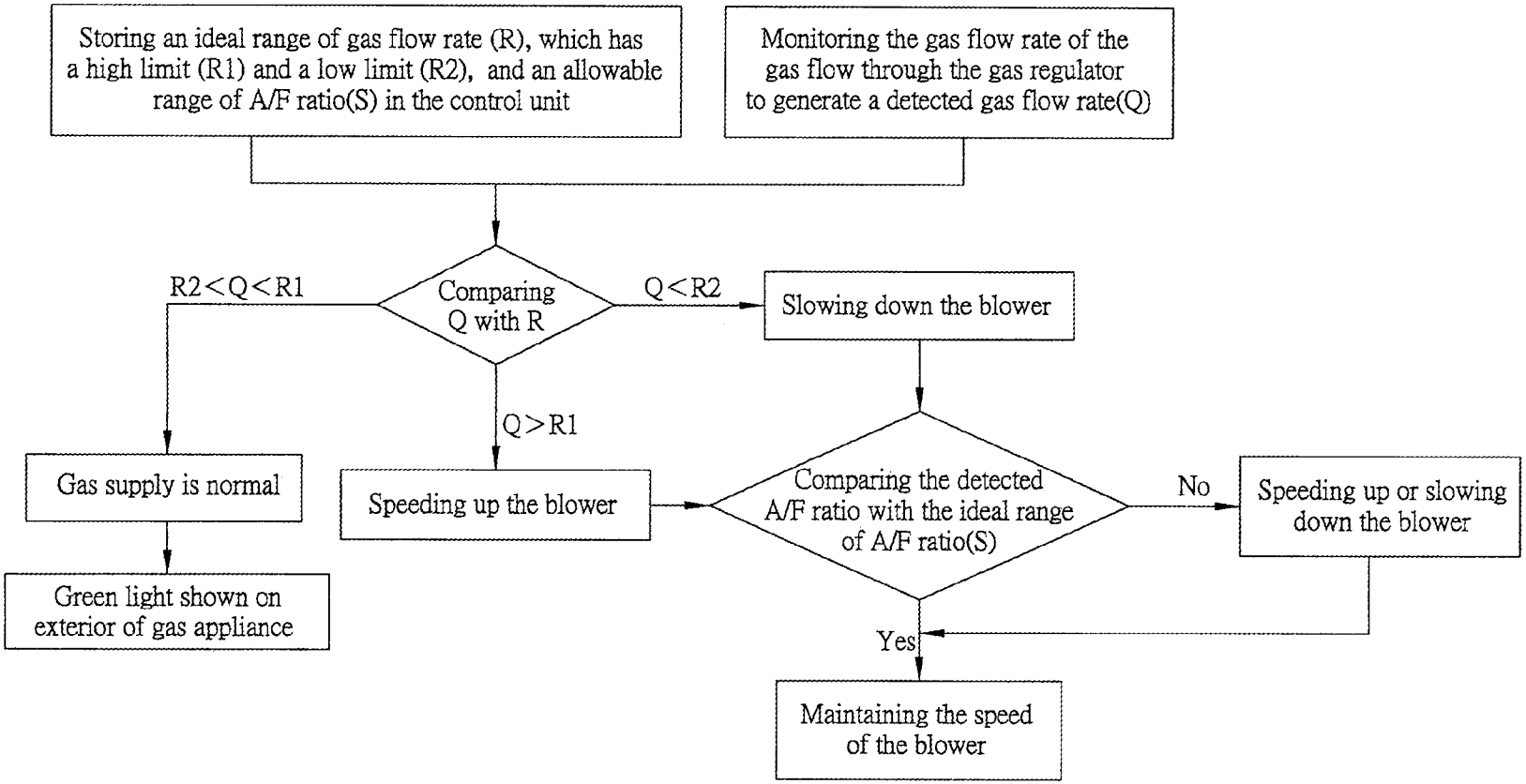
FIG. 4 is a flow chart of the compensating procedure of a second preferred embodiment of the present invention.

When an abnormal condition of the gas supply is detected, it cannot be fixed by the user; hence the gas appliance will be working under the abnormal gas supply condition and that put the gas appliance under a dangerous condition. To overcome this problem, the present invention further provides a compensating method to recover the gas supply when the gas supply is acting abnormally. As shown in FIG. 3, the compensating method includes the following steps:

When a detected gas flow Q is higher than the high limit R1 of the ideal range of gas flow rate R, it indicates that the pressure of the gas is too high so that the mixed gas will have a higher A/F ratio. The control unit 208, after a preset calculation according to the detected gas flow Q, controls the gas regulator 204 to reduce the gas flow rate that the A/F ratio of the mixed gas will be reduced to the target A/F ratio to have a complete, normal burning function in the gas appliance.

On the contrary, when a detected gas flow Q is lower than the low limit R2 of the ideal range of gas flow rate R, it indicates that the pressure of the gas is too low so that the mixed gas will have a lower A/F ratio. The control unit 208, after a preset calculation according to the detected gas flow Q, controls the gas regulator 204 to increase the gas flow rate that the A/F ratio of the mixed will be raised to the target A/F ratio to have a complete burning function in the gas appliance.

The sensor 206 keeps monitoring the gas flow rate, and the control unit 208 will control the gas regulator 204 to change the gas flow rate until the new gas flow rate falls between the high limit R1, and the low limit R2 of the ideal range of gas flow rate R, when the detected gas flow Q exceeds the high limit R1 and the low limit R2.

The second preferred embodiment of the present invention provides another compensating method which applies to a gas appliance with a blower 210. The compensating method of the second preferred embodiment changes the gas flow rate by the blower 210, rather than the gas regulator 204. The compensating method includes the following steps:

The control unit 208 further is stored with an allowable range of A/F ratio S.

The sensor 206 keeps monitoring a gas flow rate through the gas regulator 204 for a detected gas flow Q transmitted to the control unit 208, and the control unit controls the blower 210 according to the detected gas flow Q, wherein When a detected gas flow Q is higher than the high limit R1 of the ideal range of gas flow rate R, it indicates that the pressure of the gas is too high so that the mixed gas will have a higher A/F ratio. The control unit 208, after a preset calculation according to the detected gas flow Q, controls the blower 210; allows it to speed up and to raise an air flow rate into the combustor 202*a* that will reduce the A/F ratio of the mixed gas.

On the contrary, when a detected gas flow Q is lower than the low limit R2 of the ideal range of gas flow rate R, it indicates that the pressure of the gas is too low so that the mixed gas will have a lower A/F ratio. The control unit 208, after a preset calculation according to the detected gas flow Q, controls the blower 210, allows it to slow down and to reduce an air flow rate into the combustor 202*a* that will raise the A/F ratio of the mixed gas.

In the present invention, the gas appliance further is provided with an oxygen sensor 212 to monitor the A/F ratio. The control unit 208 controls the blower 210 to speed up or slow down; and to change the air flow rate until a new A/F ratio falls into the allowable range of A/F ratio S again, and when the oxygen sensor 212 detects an A/F ratio that exceeds the allowable range of A/F ratio S.

The description above is a few preferred embodiments of the present invention and the equivalence of the present invention is still in the scope of claim construction of the present invention.

What is claimed is:

1. A method of testing gas supply of a residential gas appliance, wherein the residential gas appliance has a control unit storing an ideal range of gas flow rate, and wherein a pipeline is connected to the gas appliance to supply gas to the gas appliance, the method comprising the steps of:

controlling a cross section of the pipeline with an adjustable gas regulator;

monitoring a flow rate of the gas flowing through the cross section of the pipeline, while the cross section of the pipeline remains unchanged due to control of the gas regulator, to generate a detected gas flow rate;

comparing the detected gas flow rate with the ideal range of gas flow rate;

providing an alarm when the detected gas flow rate is higher than a high limit of the ideal range or is lower than a low limit of the ideal range of gas flow rate, wherein the alarm is provided in response to the detected gas flow being outside of the ideal range;

reducing the flow rate of the gas flow in the pipeline if the detected gas flow rate is higher than the high limit of the ideal range of gas flow rate, or raising the flow rate of the gas flow in the pipeline if the detected gas flow rate is lower than the low limit of the ideal range of gas flow rate until the detected gas flow rate falls back into the ideal range of gas flow rate;

wherein the pipeline is provided with a sensor between the gas regulator and an outlet of the pipeline to monitor the flow rate of the gas flow;

wherein a gas supply in the pipeline is determined to be abnormal if the detected gas flow rate is higher than the high limit of the ideal range or is lower than the low limit of the ideal range of gas flow rate;

wherein the alarm informs a user that the gas supply is under an abnormal condition, which is not happening inside the residential gas appliance;

wherein the flow rate of the gas flow in the pipeline is changed by providing the gas regulator a voltage to control the gas regulator changing a size of a cross section of the pipeline according to the voltage;

wherein, after the detected gas flow rate falls back into the ideal range of gas flow rate, the size of the cross section of the pipeline remains unchanged;

wherein, while reducing the flow rate of the gas flow in the pipeline, the flow rate is always greater than 0, and the cross section of the pipeline is never completely closed.

2. The method as defined in claim 1, further comprising the step of raising an air flow rate of an air flow into the gas appliance when the detected gas flow rate is higher than the high limit of the ideal range of gas flow rate, or reducing the air flow rate of the air flow into the gas appliance when the detected gas flow rate is lower than the low limit of the idea range of gas flow rate so that an air to fuel ratio of the mixed gas is adjusted to fall within an allowable range of air to fuel ratio.

3. The method as defined in claim 2, wherein the gas appliance is provided with a blower to change the air flow rate of the air flow into the gas appliance by speeding up or slowing down the blower.

4. The method as defined in claim 2, wherein the gas appliance is provided with an oxygen sensor electrically connected to the control unit to monitor an air fuel ratio in the gas appliance.

* * * * *